US005630454A

United States Patent [19]

Koike

[11] Patent Number: 5,630,454

[45] Date of Patent: May 20, 1997

[54] CUTTING BLADE HOLDING DEVICE IN VENEER LATHE

[75] Inventor: Masaru Koike, Obu, Japan

[73] Assignee: Meinan Machinery Works, Inc., Obu, Japan

[21] Appl. No.: 552,476

[22] Filed: Nov. 9, 1995

[30] Foreign Application Priority Data

Nov. 14, 1994 [JP] Japan ..... 6-305494

[51] Int. Cl.[6] ..... B27L 5/00

[52] U.S. Cl. ..... 144/212; 144/211

[58] Field of Search ..... 144/209.1, 211, 144/212, 218, 230

[56] References Cited

U.S. PATENT DOCUMENTS

| | | | |
|---|---|---|---|
| 645,881 | 3/1900 | Williams | 144/212 |
| 3,006,392 | 10/1961 | Elford | 144/212 |
| 3,204,673 | 9/1965 | Nordin | 144/212 |
| 3,866,642 | 2/1975 | Walser | 144/212 |

*Primary Examiner*—W. Donald Bray
*Attorney, Agent, or Firm*—Armstrong, Westerman, Hattori, McLeland & Naughton

[57] ABSTRACT

A cutting blade holding device is disclosed which is capable of preventing damage to a blade stock per se to improve operational efficiency of a veneer lathe per se and to reduce a maintenance cost. The cutting blade holding device in a veneer lathe which is supported by a frame F of the veneer lathe with its cutting blade 19 kept in parallel with a log W to be peeled and which comprises: a blade stock 5 having its side facing the log W formed with a blade retaining portion 7 for retaining the cutting blade, the cutting blade 19 being detachably mounted in the blade retaining portion 7 of the blade stock 5, and an abutment member 25 as a member separate from the blade stock 5, which is separately replaceably disposed in the upper end portion of the blade retaining portion 7 in the vicinity of a cutting edge of the cutting blade 19 mounted in the blade retaining portion 7.

5 Claims, 7 Drawing Sheets

PRIOR ART

CUTTING BLADE HOLDING DEVICE IN VENEER LATHE

BACKGROUND OF THE INVENTION

1. Field of the Invention

The present invention relates to a cutting blade holding device of a veneer lathe for peeling a veneer from a log.

2. Description of the Prior Art

In a conventional veneer lathe, for example, as in a veneer lathe 1 shown in FIG. 7, spindles S, S for chucking a log W by end surfaces are rotatably mounted in a body frame F. On the body frame F, a blade stock 5 is mounted movably in a direction perpendicular to an axis L of the spindles S, S by means of transfer means D. On the surface facing the log W of the blade stock 5, a cutting blade B is mounted with its cutting edge located at the upper position in terms of rotational direction of the log W generally via a backing plate (not shown) (see U.S. Pat. No. 4,496,155). At upper positions in terms of the rotational direction of the log W and in terms of veneer traveling direction relative to the cutting blade B, nose bars are disposed. The blade stock 5 is moved toward the log W by actuating the transfer means D to press the cutting blade B against the peripheral surface of the rotating log W, whereby the log W is peeled into a veneer. The peeled veneer travels passing through between the nose bars N and the cutting blade B in the right upper direction in FIG. 7 and is delivered.

FIG. 6 is an explanatory view showing condition of attachment of a cutting blade B to on a blade stock 5 in another conventional veneer lathe. In the same manner as in the case shown in FIG. 7, to the rear surface (the surface facing the log W) of the blade stock 5 mounted movably in a direction perpendicular to an axis of spindles (not shown) which chuck a log W by end surfaces is fixedly applied a backing plate Bb with its bevel located at the upper position in terms of rotation of the log W (the upper course of a veneer traveling direction), and the cutting blade B held by a cutting blade holder Bc is pressed against the backing plate Bb by means of a blade presser, which is held by the blade stock 5 and oscillatory by a cylinder C, to hold the backing plate Bb between the blade stock 5 and the cutting blade B (see Japanese Utility Model Unexamined Publication No. 60606/1988).

The blade stock 5 and the backing plate Bb have such upper surfaces that, in their sections in the traveling direction of the shaved veneer V, the upper end portions thereof at the upper course of the traveling direction together form an acute-angular tip portion 51 and Bb1, and the upper surfaces constitute a continuous guide surface G downwardly slanting from the upper course to the lower course of the traveling direction of the veneer V. Along the guide surface G, the shaved veneer V is delivered.

The backing plate Bb and the blade stock 5 receive forces exerted on the cutting blade B during veneer peeling such as horizontal cutting resistance force in the direction departing from the log and toward the lower course of the veneer traveling direction to regulate deflection of the cutting blade B, thereby enabling a veneer to be shaved in a substantially uniform thickness.

However, there is undesired possibility that a tip portion of the cutting blade B is considerably deflected in the direction departing from the log W, according to angle condition of the cutting edge of the cutting blade B or at times of cutting knots, to cause breakage of the acute-angular tip portion K1 of the blade stock K. In particular, the blade stock K is as large in the direction perpendicular to the traveling direction of the veneer V as at least the axial length of the log W, and is thus made by casting to reduce production cost thereof. However, a casting is extremely susceptible to breakage by excessive force abruptly exerted thereon. Accordingly, an acute-angular tip portion K1 thereof is particularly likely to be damaged.

If a veneer V is peeled off with the acute-angular tip portion K1 of the blade stock K broken, the cutting blade B and the backing plate Bb are held unstably due to the breakage of the acute-angular tip portion K1 and the position of the cutting edge is deflected to the direction departing from the log W. This prevents a veneer being peeled off in a substantially uniform thickness.

This drawback may be solved by replacing the blade stock K with its acute-angular tip portion K1 broken by new one. However, since the blade stock is large and heavy as mentioned above, replacement thereof requires much labor and time and is expensive. Accordingly, problems are caused in that operational efficiency of the veneer lathe per se is extremely impaired, which leads to extremely impaired production efficiency of a veneer, and that cost of the replacement is high.

Further, the drawback may be solved with a blade stock K made of a steel which is hardly broken. In this case, however, an acute-angular tip portion K1 thereof is likely to undergo plastic deformation or bending to result in uneven position of the cutting edge of the cutting blade B. This prevents a veneer from being peeled off in a substantially uniform thickness.

SUMMARY OF THE INVENTION

The present invention has been made to solve the above problems inherent in the conventional techniques. It is, therefore, an object of the present invention to provide a cutting blade holding device of a veneer lathe, which is capable of stably holding a cutting blade B to peel off a veneer V in a substantially uniform thickness.

It is another object of the present invention to provide a cutting blade holding device of a veneer lathe, which is capable of preventing breakage of a blade stock K, improving operational efficiency of the veneer lathe, and realizing a reduced maintenance cost.

The above objects are attained by the following cutting blade holding device according to the present invention. In other words, as a preferred embodiment of the present invention, there is provided a cutting blade holding device in a veneer lathe, said cutting blade holding device being supported by a frame of the veneer lathe with its cutting blade kept in parallel with a log to be peeled, and said cutting blade holding device comprising:

a blade stock having its side facing the log formed with a blade retaining portion for retaining the cutting blade, the cutting blade being detachably mounted in the blade retaining portion of the blade stock, and an abutment member as a member separate from the blade stock, which is separately replaceably disposed in the upper end portion of the blade retaining portion in the vicinity of a cutting edge of the cutting blade mounted in the blade retaining portion.

The preferred embodiment may further comprise a backing plate interposed between the blade retaining portion of the blade stock and the cutting blade.

According to another preferred embodiment, there is provided a cutting blade holding device in a veneer lathe which peels off a veneer with a cutting blade caused to abut on a peripheral surface of a log chucked by spindles to rotate in a predetermined direction, said cutting blade holding device comprising:

a blade stock supported movably relative to a body frame in a veneer traveling direction perpendicular to an axis of the spindles, and having its upper side in terms of the veneer traveling direction formed with a cutting blade retaining portion having notches, a backing plate mounted on the upper side of the blade stock in terms of the veneer traveling direction with the top of its upper side in terms of the veneer traveling direction located adjacently to a cutting edge of the cutting blade, and having its upper surface formed into a first guide surface extending from the upper course toward the lower course in its section along the veneer traveling direction, an abutment member mounted on the blade retaining portion of the blade stock located on the lower side of the backing plate in terms of the veneer traveling direction, and having its upper side in terms of the veneer traveling direction formed with an engagement portion for engaging with the upper notch, and having its upper surface formed into a second guide surface whose upper end in terms of veneer traveling direction is substantially continuous with the lower end of the first guide surface of the backing plate in terms of the veneer traveling direction and which extends from the upper course toward the lower course in its section along the veneer traveling direction, and blade presser members supported on the upper side of the blade stock in terms of the veneer traveling direction for oscillation, which press the cutting blade supported on the upper end of the backing plate in terms of the veneer traveling direction to secure the cutting blade.

According to still another preferred embodiment, there is provided a cutting blade holding device in a veneer lathe which peels off a veneer with a cutting blade caused to abut on a peripheral surface of a log chucked by spindles to rotate in a predetermined direction, said cutting blade holding device comprising:

a blade stock supported movably relative to a body frame in a veneer traveling direction perpendicular to an axis of the spindles, and having its upper side in terms of the veneer traveling direction formed with a cutting blade retaining portion having notches, a backing plate mounted on the upper side of the blade stock in terms of the veneer traveling direction with the top of its upper side in terms of the veneer traveling direction located adjacently to a cutting edge of the cutting blade, and having its upper surface formed into a third guide surface extending from the upper course toward the lower course in its section along the veneer traveling direction, and having its lower side in terms of the veneer traveling direction formed with an engagement portion, an abutment member mounted on the blade retaining portion of the blade stock located on the lower side of the backing plate in terms of the veneer traveling direction, and having its upper side in terms of the veneer traveling direction formed with an engagement portion for engaging with both the upper notch of the cutting blade retaining portion and the engagement portion of the backing plate, and having its upper surface formed into a fourth guide surface whose upper end in terms of veneer traveling direction is substantially continuous with the lower end of the third guide surface of the backing plate in terms of the veneer traveling direction and which extends from the upper course toward the lower course in its section along the veneer traveling direction, and blade presser members supported on the upper side of the blade stock in terms of the veneer traveling direction for oscillation, which press the cutting blade supported on the upper end of the backing plate in terms of the veneer traveling direction to secure the cutting blade.

In the cutting blade holding device according to the present invention, if the above-described force in the direction departing from the log becomes excessive, the blade stock per se is not damaged but the abutment member detachably disposed on the blade stock is first damaged. Therefore, by replacing the damaged abutment member by new one without replacement of the blade stock as a whole as required in a conventional cutting blade holding device for in a veneer lathe, it is possible to hold the cutting blade again in the same state as the initial one.

In the preferred embodiment of the cutting blade holding device in a veneer lathe according to the present invention, the backing plate is mounted on the upper surface of the blade retaining portion in terms of the veneer traveling direction with the interposition of the abutment member mounted on the blade retaining portion of the blade stock with its engagement portion engaged with the notch of the blade retaining portion, and then the cutting blade placed on the upper side surface of the backing plate in terms of the veneer traveling direction is pressed by the oscillatory blade presser members to secure the cutting blade therebetween.

At the time of cutting a log, force in the direction departing from the log is exerted on the cutting blade. However, the cutting blade is restrained from deflecting by the backing plate and the abutment member, which would otherwise be deflected. This enables the cutting edge of the cutting blade to be kept substantially at a constant position to peel off a veneer in a substantially uniform thickness.

If the abutment member is broken by the force in the direction departing from the log, by replacing the damaged abutment member by new one without replacement of the blade stock as a whole as required in a conventional cutting blade holding device for in a veneer lathe, it is possible to hold the cutting blade again in the same state as the initial one.

In alternative preferred embodiment of the present invention, with the interposition of the abutment member mounted on the blade retaining portion of the blade stock with its engagement portion engaged with the notch of the blade retaining portion, the backing plate is mounted on the upper surface of the blade retaining portion in terms of the veneer traveling direction with the engagement portion of the abutment member engaged with its engagement portion, and then the cutting blade placed on the upper side surface of the backing plate in terms of the veneer traveling direction is pressed by the oscillatory blade presser members to secure the cutting blade therebetween.

During peeling of a log, the cutting blade is restrained from deflecting by the backing plate and the abutment member, which would otherwise be deflected by the force in the direction departing from the log is exerted on the cutting blade. In this case, since the abutment member is so formed as to have non acute-angular portion, it is seldom broken by the forces exerted on the cutting blade. This enables the cutting edge of the cutting blade to be kept substantially at a constant position to peel off a veneer in a substantially uniform thickness.

If the abutment member is broken by the force toward the lower course of the veneer traveling direction, only the damaged abutment member may be replaced by new one without replacing the blade stock as a whole to maintain the cutting blade, as in the above-mentioned embodiment.

DESCRIPTION OF THE PREFERRED EMBODIMENTS

Figure 1:
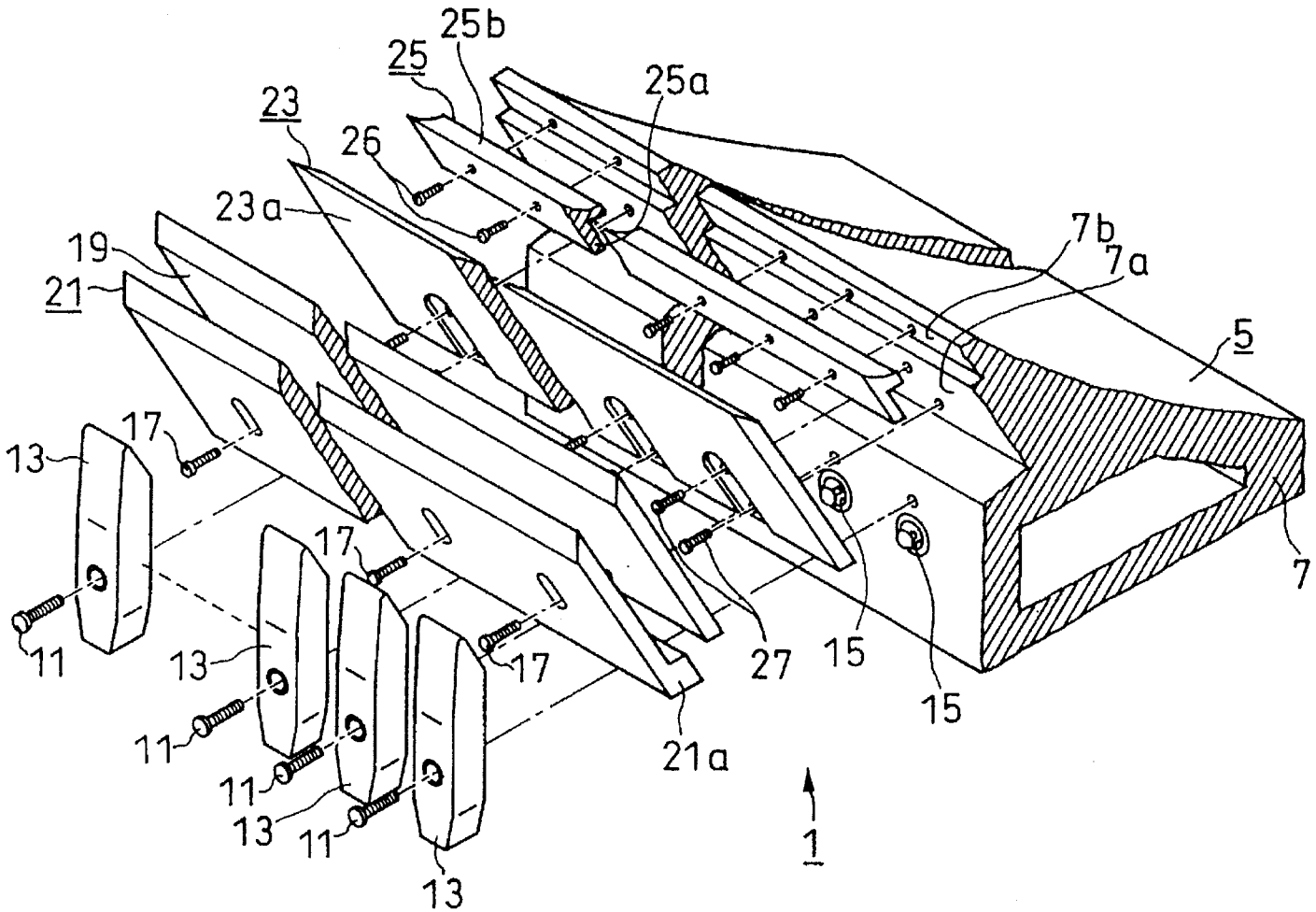
FIG. 1 is an exploded perspective view of one embodiment of the cutting blade holding device for a veneer lathe according to the present invention.

Now, one embodiment of the present invention will be described with reference to the drawings.

The cutting blade holding device of the present invention as such may be applied, for example, to the conventional veneer lathe which has been described with reference to FIG. 7. Accordingly, in the following description, explanation will be made only on the cutting edge holding device, and suffice it to say that the same reference characters as used in the explanation with reference to FIG. 7 represent like parts, and thus explanation on the veneer lathe as a whole will be omitted.

Figure 2:
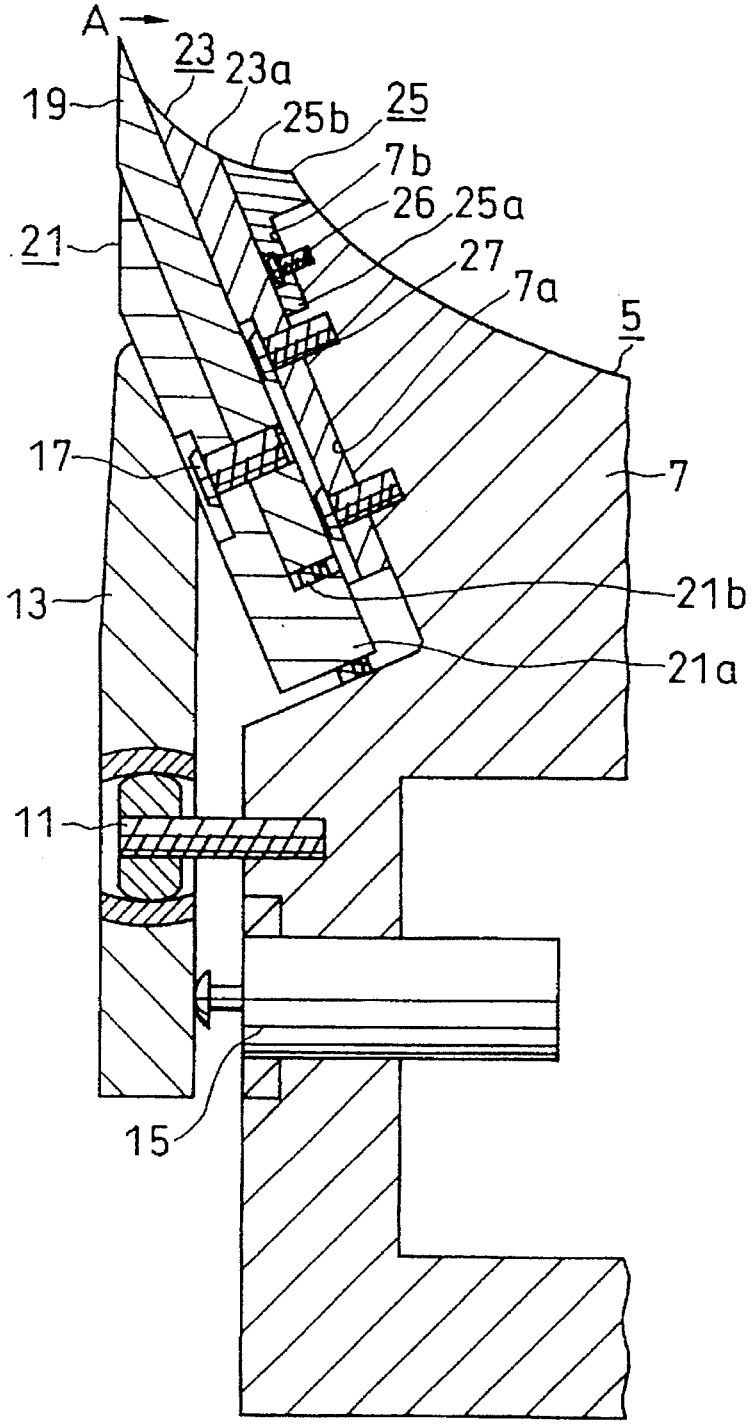
FIG. 2 is a longitudinal sectional view of the cutting blade holding device.

Referring to FIGS. 1 and 2, a blade stock 5 is held at its ends by a body frame F of a veneer lathe 1 in such a manner that it is movable in a veneer traveling direction perpendicular to an axis of spindles S which chuck a log W to be peeled, and the blade stock 5 is moved by rotations of threaded transfer bars as transfer means D each of which is connected to an electric motor mounted on the body frame F and in mesh with the blade stock. The blade stock 5 is longer in the direction perpendicular to the traveling direction of a veneer V than an axial length of the log W, and made of a casting having its upper portion on the side facing the log W integrally formed with a blade retaining portion 7. The blade retaining portion 7 is located with its upper end located at a level slightly lower than the axis of the spindles S, and in its upper side in terms of the veneer traveling direction, it has a first notch 7*a* and a second notch 7*b* above the first notch 7*a*. The blade retaining portion 7 preferably has non acute-angular upper portion in its section along the veneer traveling direction to effectively prevent breakage of the blade retaining portion 7 per se in the blade stock 5.

Figure 7:
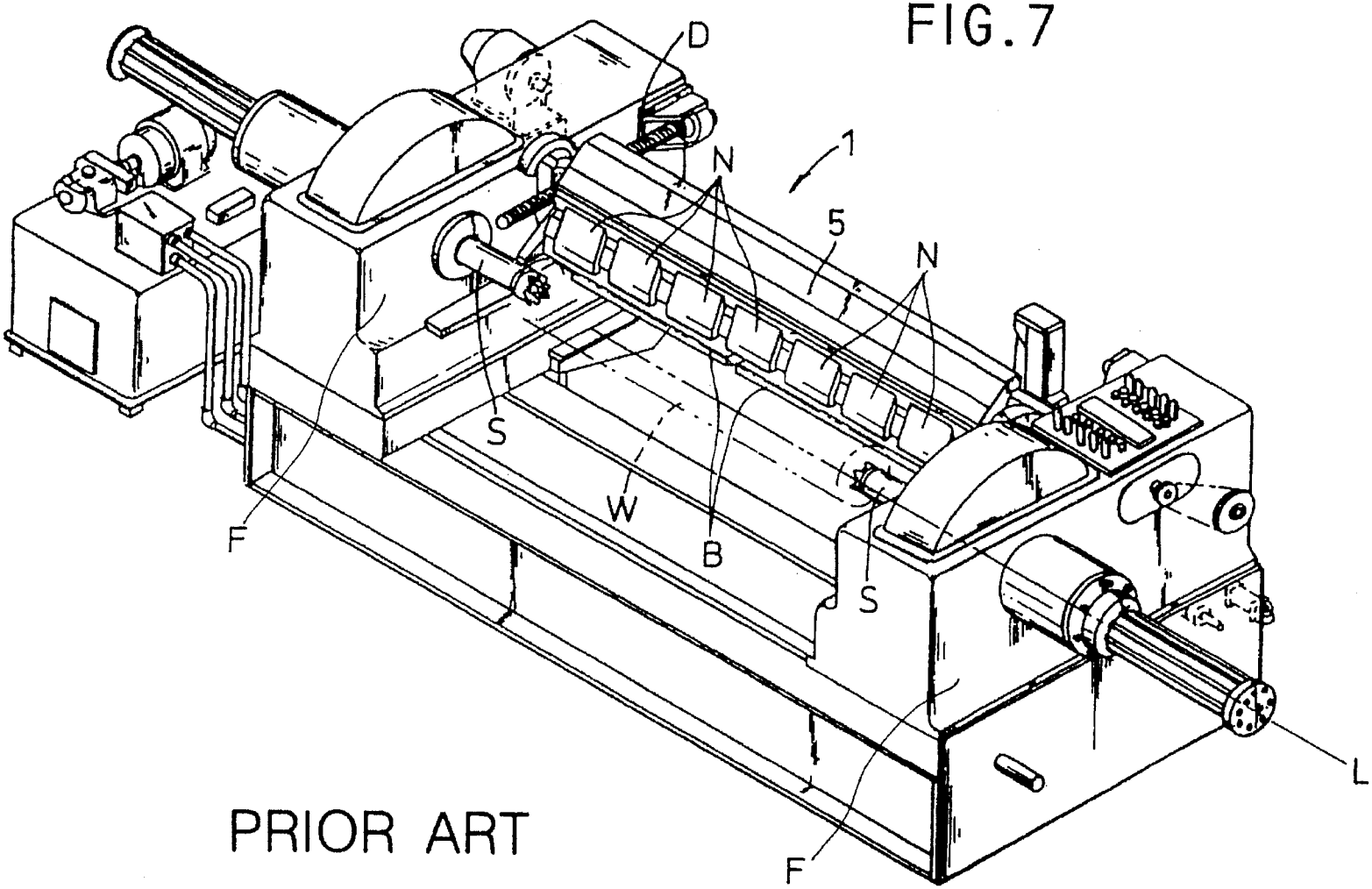
FIG. 7 PRIOR ART
FIG. 7 is a perspective view showing another conventional veneer lathe.

With respect to the mode for rotating the log W, the veneer lathe 1 is not restricted to the spindle driving mode as shown in FIG. 7 which comprises rotationally driving the spindles S to cause the log W to rotate in a predetermined direction. The mode for rotating the log may be a peripheral surface driving mode which comprises causing a plurality of driving rolls mounted on a driving shaft supported by blade stock 5 for rotational driving to bite-engage with a peripheral surface of a log chucked by spindles at a level slightly above the axis of the log to rotate the log in a predetermined direction, although no particular illustration is given. Further, a mode using combination of the above-mentioned driving forces to rotate a log may be employed.

On a lower portion of a side of the blade stock 5 which is the upper side in terms of the veneer traveling direction, supporting pins 11 are mounted at predetermined intervals in the direction perpendicular to the veneer traveling direction. By the free end of each of the supporting pins 11, a blade presser member 13 is supported at a mid position thereof for oscillation. Cylinders 15 are mounted in the blade stock 5 so that a rod of each of the cylinder 15 abuts on a lower end portion of each of the blade presser member 13. Each of the blade pressers 13 is permitted to oscillate by actuation of each of the cylinders 15, and a blade holder 21 which will be described below is pressed by tip portions of the blade pressers 13 toward the blade retaining portion 7 to securely hold a blade 19.

On the upper side of the blade retaining portion 7 in terms of veneer traveling direction, the blade holder 21 to which the blade 19 is fixedly attached with bolts 17 is retained in the first notch 7*a* with a backing plate 23 and an abutment member 25 which will be described below interposed therebetween. The blade holder 21 is made of a metal, and has a length substantially the same as the dimension of the blade stock 5 in the direction perpendicular to the veneer traveling direction, and has at its lower end a supporting portion 21*a* protruding toward the lower course of veneer traveling direction so that it has a substantially L shaped section along the veneer traveling direction. A plurality of adjusting screws 21*b* are in mesh with the supporting portion 21*a* at appropriate intervals in the direction perpendicular to the veneer traveling direction for adjustment in the vertical direction. By selecting the length of the adjusting screws 21*b*, it is possible to adjust the cutting blade 19 supported by the surface of the lower portion 21*a* in terms of the veneer traveling direction so that the cutting edge of the cutting blade 19 is always substantially in alignment with the axis of the spindles S.

Between the upper surface of the blade retaining portion 7 in terms of the veneer traveling direction and the lower surface of the cutting blade 19 in terms of the veneer traveling direction, the backing plate 23 is fixed by bolts 27. The backing plate 23 is made of a metal material such as a steel and has a length substantially the same as the dimension of the blade stock 5 in the direction perpendicular to the veneer traveling direction, and has its upper end formed into a first guide surface 23*a*. In a section of the first guide surface 23*a* along the veneer traveling direction, the upper end thereof in terms of the veneer traveling direction is located adjacently to the cutting edge of the cutting blade 19, and it has a curved shape descending from the upper course to the lower course of the veneer traveling direction. Thus, the upper portion of the backing plate 23 in terms of the veneer traveling direction is acute-angular.

On the upper portion of the blade retaining portion 7, the abutment member 25 is mounted in such a manner that an engagement portion 25*a* thereof is in engagement with the second notch 7*b*. With respect to the attachment of the abutment member 25 to the blade retaining portion 7, the abutment member 25 may be fixed to the retaining portion by means of bolts 26 or may be fixedly held between the backing plate 23 and the blade retaining portion 7. The abutment member 25 is, for example, a casting of the same type as the blade stock 5 or made of a steel, and has substantially the same length as the backing plate in the direction perpendicular to the veneer traveling direction, and has its upper end formed into a second guide surface 25*b*. In the section of the second guide surface 25*b* along the veneer traveling direction, the upper end thereof in terms of the veneer traveling direction is substantially continuous with the first guide surface 23*a* of the backing plate 23, and it has a curved shape descending from the upper course to the lower course of the veneer traveling direction. Thus, the upper portion of the abutment member 25 in terms of the veneer traveling direction is acute-angular.

Next, function of the abutment member during veneer cutting will be described.

When the cutting blade 19 is caused to abut on the peripheral surface of a log W chucked by the spindles s and rotating in a predetermined direction by moving the blade stock 5 in an amount according to a thickness of a veneer V to be peeled off, a veneer V is peeled off the log W according to the amount of the movement of the blade stock 5. At this time, forces in the direction toward the lower course of the veneer traveling direction caused due to the abutment on the peripheral surface of the log W such as pressing force and cutting resistance are exerted on the cutting blade 19. However, the cutting blade 19 is restrained from deflecting by the backing plate 23 and abutment member 25, the cutting edge of which would otherwise be deflected in the direction of the arrow A shown in a solid line in FIG. 2. Accordingly, the cutting edge is substantially kept at a constant position, thereby enabling a veneer V to be peeled off in a substantially uniform thickness. The veneer V thus peeled off is delivered out of the veneer lathe 1 while being guided along the first guide surface 23*a* of the backing plate 23 and the second guide surface 25*b* of the abutment member 25.

Figure 3:
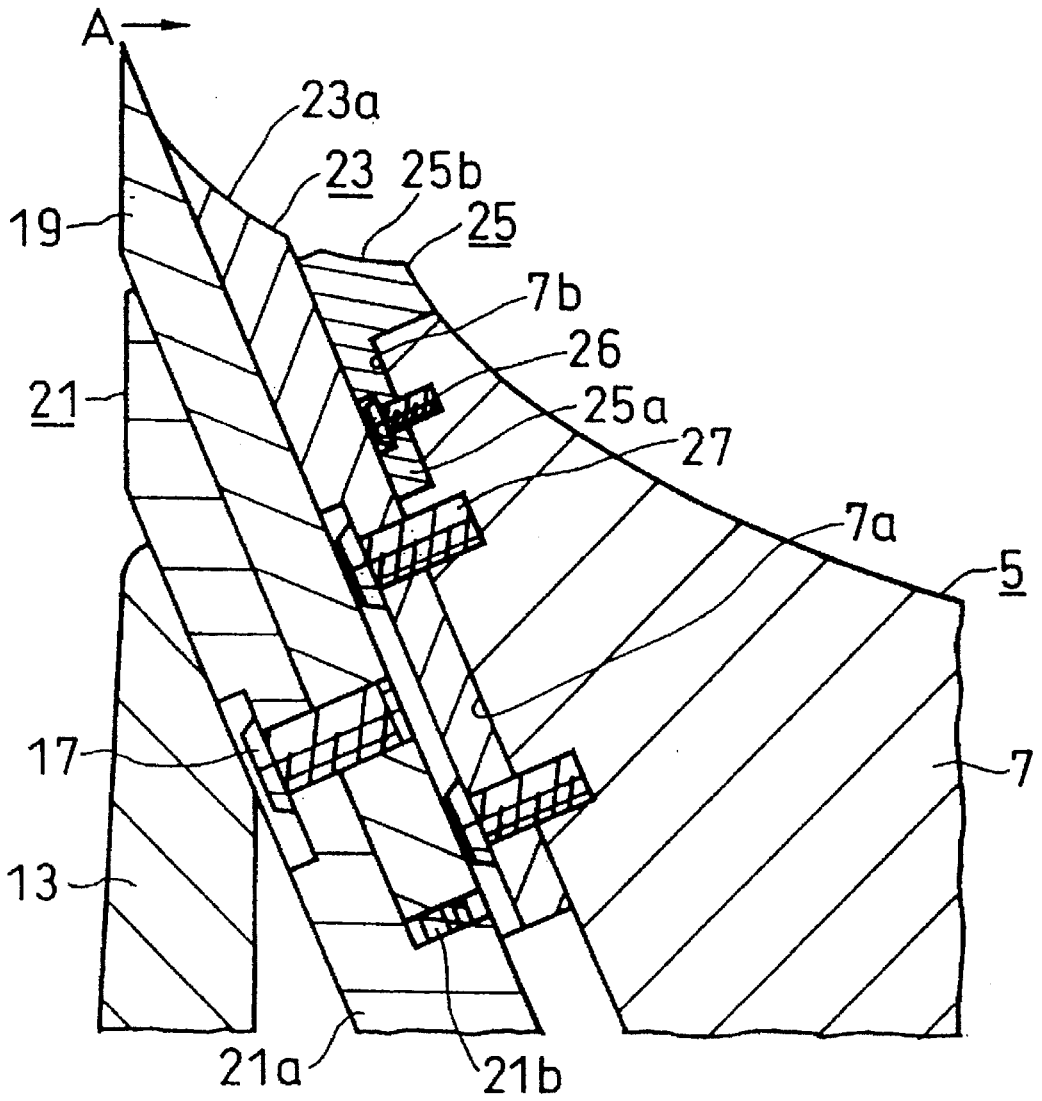
FIG. 3 is a longitudinal sectional view showing damaged state of an abutment member.

However, the cutting edge of the cutting blade 19 can be considerably deflected in the direction departing from the log W, i.e., in the direction toward the lower course of the veneer traveling direction, depending on angle condition of the cutting edge of the cutting blade 19 or at times of cutting knots, to strongly press the acute-angular portion of the abutment member 25, thereby causing breakage of the acute-angular portion as shown in a chain line in FIG. 3. If the acute-angular portion of the abutment member 25 is broken, the cutting blade 19 cannot be prevented from deflecting in the direction toward the lower course of the veneer traveling direction, thus leading to deflection of the cutting edge thereof in the direction departing from the log W. This prevents a veneer V from being peeled off in a substantially uniform thickness. It is to be noted that when the cutting blade retaining portion 7 of the blade stock 5 is so formed as to have non acute-angular portion in its section along the veneer traveling direction, the cutting blade retaining portion 7 seldom undergoes breakage even if the cutting blade 19 is considerably deflected by excessive cutting resistance or the like exerted thereon.

Accordingly, if the acute-angular portion of the abutment member 25 is broken, it is sufficient therefor to replace the abutment member 25 by new one. Without replacement of the blade stock 5 per se as required in the conventional case, only the abutment member 25 may be replaced by new one. Therefore, in comparison with the conventional case, replacement operation can be carried out in an extremely shortened time at a low cost.

Figure 4:
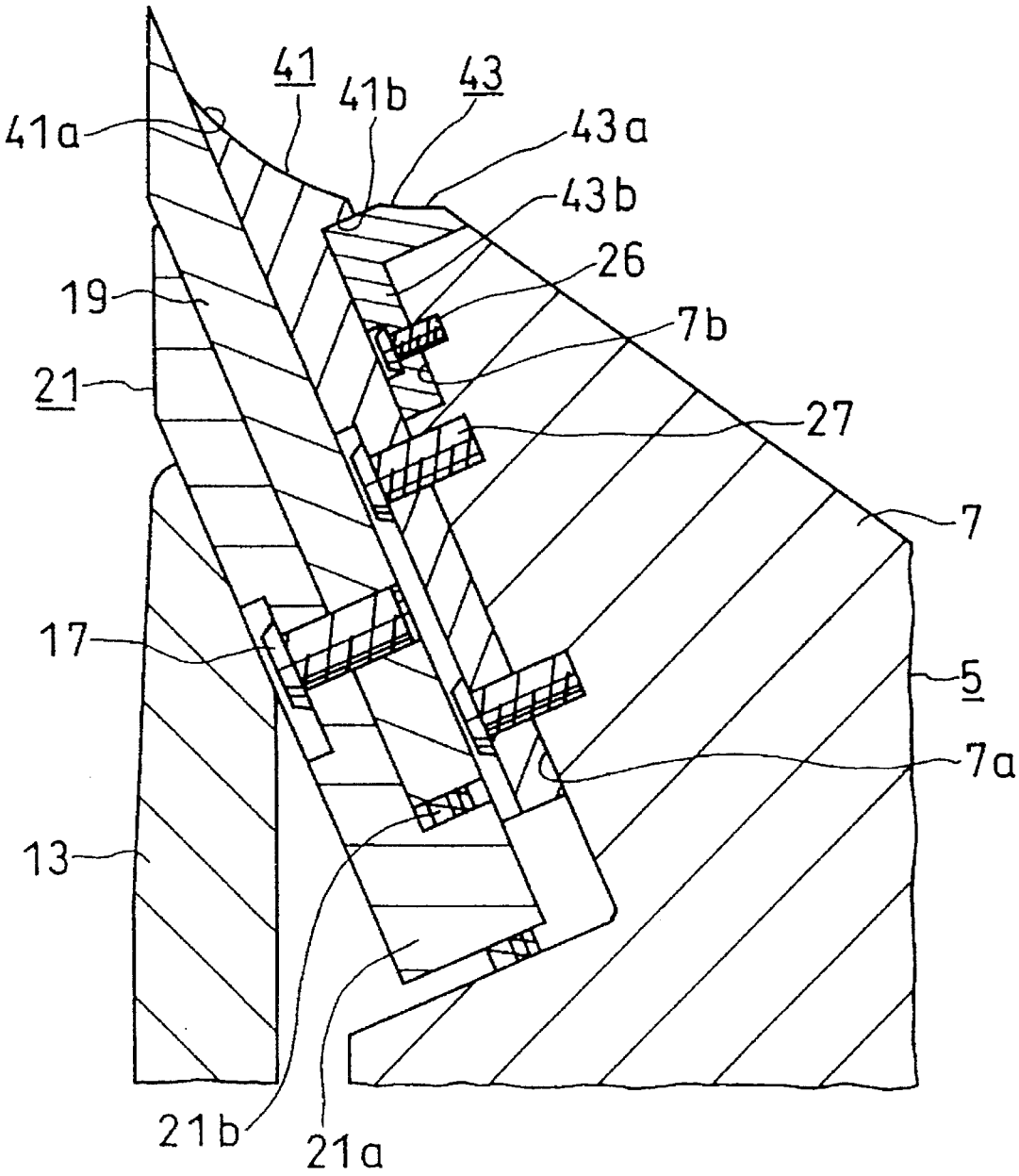
FIG. 4 is a longitudinal sectional view showing another embodiment of the cutting blade holding device for a veneer lathe.

In FIG. 4, another embodiment of the present invention is shown. In this embodiment, a backing plate 41 and an abutment member 43 are configured as follows. With respect to other components, suffice it to say that since they are the same as those in the embodiment shown in FIGS. 1 to 3, the same reference characters will be allotted thereto in FIG. 4, and thus explanation thereon will be omitted.

Referring to FIG. 4, the backing plate 41 has its upper surface formed into a third guide surface 41*a* substantially the same as the first guide surface 23*a* in the first embodiment and its lower side surface in terms of the veneer traveling direction with an engagement portion 41*b*. Thus, the upper end of the backing plate 41 has its upper and lower portions in terms of the veneer traveling direction formed into acute-angular shapes.

The abutment member 43 has its upper surface formed into a fourth guide surface 43*a*. In the section of fourth guide surface 43*b* along the veneer traveling direction, the upper end thereof in terms of the veneer traveling direction is substantially continuous with the third guide surface 41*a* of the backing plate 41, and it has a curved shape descending from the upper course to the lower course of the veneer traveling direction. On the upper side of the abutment member 43 in terms of the veneer traveling direction, an engagement portion 43*b* is formed which engages with both the engagement portion 41*b* of the backing plate 41 and the second notch 7*b* of the blade retaining portion 7. Thus, the upper portion of the abutment member 43 is formed into a non-acute angular shape in its section along the veneer traveling direction.

Together with the backing plate 41, the abutment member 43 configured as described above and attached to the blade retaining portion 7 of the blade stock 5 receives forces exerted on the cutting blade 19 during cutting, such as cutting resistance in the direction toward the lower course of the veneer traveling direction exerted on the cutting blade 19 during cutting to restrain the cutting blade 19 from deflecting, as described in the previous embodiment. By virtue of the non-acute angular shape of the abutment member 43, the abutment member 43 has characteristic feature in that it is less susceptible to breakage as compared even with the abutment member 25 in the previous embodiment even if the cutting blade 19 is considerably deflected depending upon angle condition of the cutting edge of the cutting blade 19 or at times of cutting knots. Further, if the abutment member 43 is damaged, only the abutment member 43 may be replaced by new one as in the case of the abutment member 25 in the previous embodiment. Thus, replacement thereof can be carried out extremely easily. Of course, as in the case of the previous embodiment, it is not necessary to replace the blade stock 5 per se.

Figure 5:
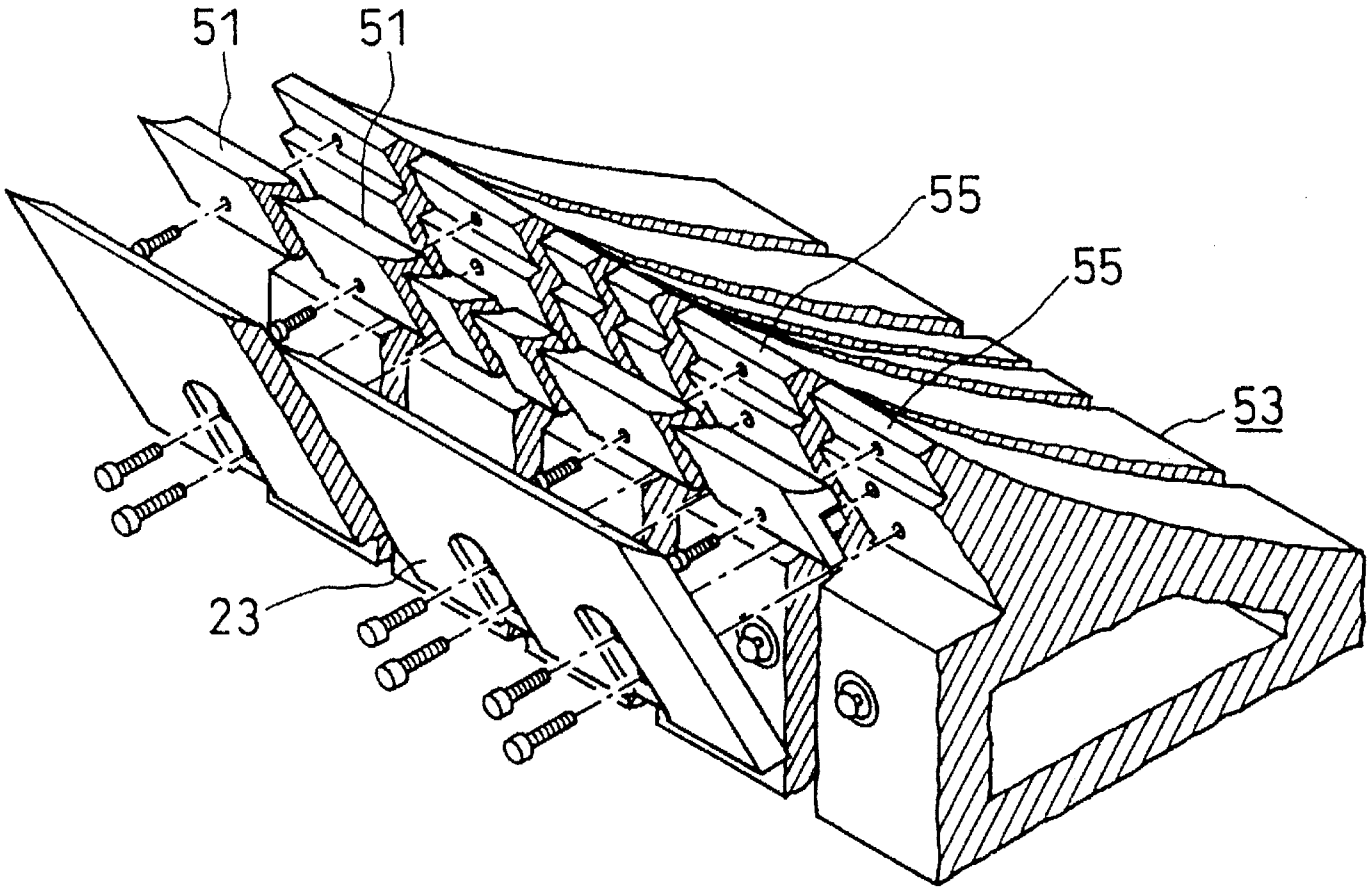
FIG. 5 is an exploded perspective view showing an alternative embodiment.
Figure 6:
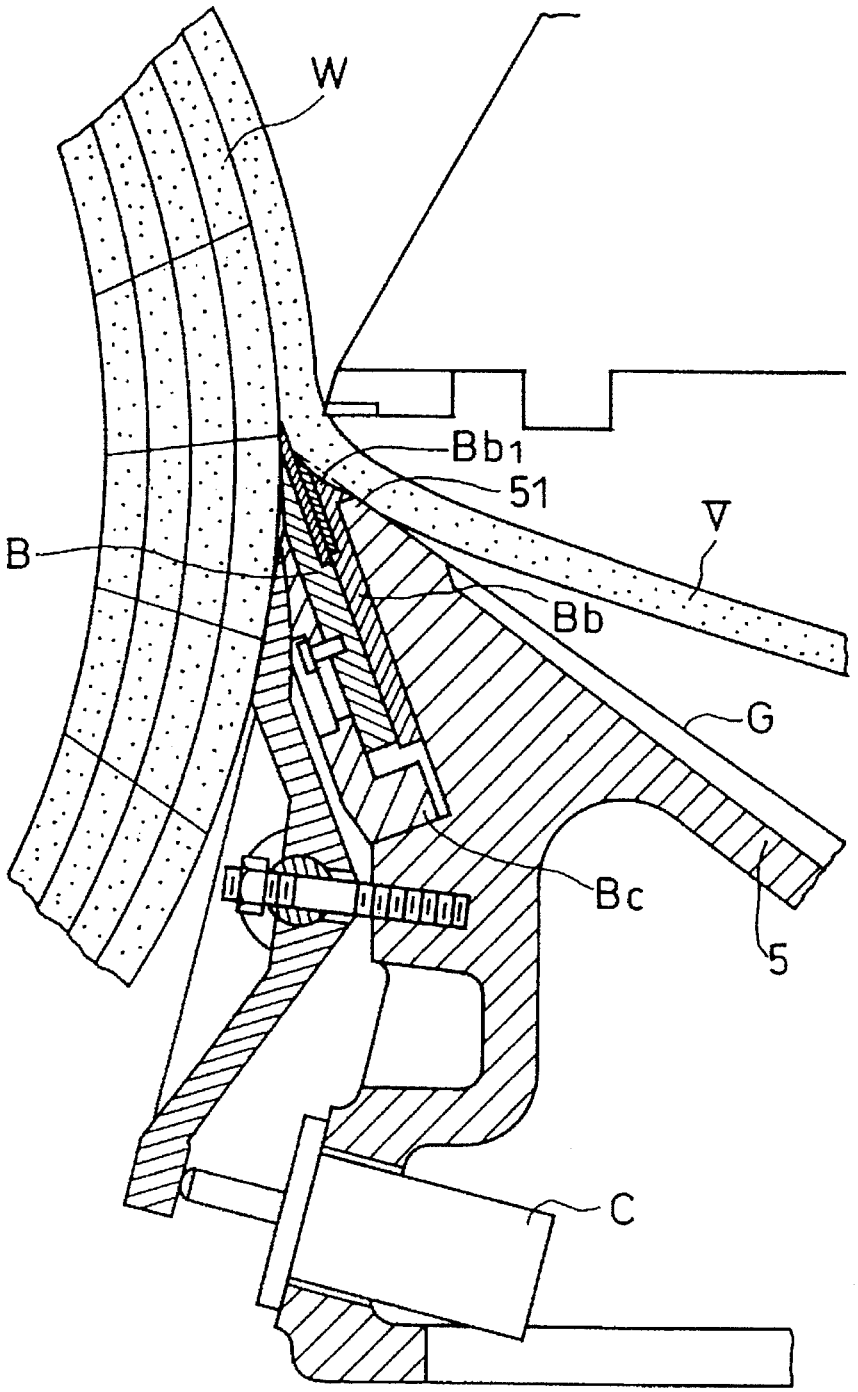
FIG. 6 is a sectional view of a conventional veneer lathe.

With respect to the above embodiments, each of the abutment members 25, 43 is described as a single-part member extending in the direction perpendicular to the veneer traveling direction. As shown in FIG. 5, however, such an abutment member may be the abutment member 51 comprising a plurality of individual parts arranged in a row in the direction perpendicular to the veneer traveling direction. In this connection, the abutment member 51 is shown in FIG. 5 which has its section along the veneer traveling direction as in the embodiment shown in FIGS. 1–3. Of course, however, the abutment member 51 may be of the sectional shape as in the embodiment shown in FIG. 4.

In other words, referring to FIG. 5, a plurality of individual blade retaining portions 55 are formed in a blade stock 53 at predetermined intervals in the direction perpendicular to the veneer traveling direction, the abutment member 51 is fixed to the upper side of each blade retaining portion 55 in terms of the veneer traveling direction, and a backing plate 23 as a single-part member extending in the direction perpendicular to the veneer traveling direction is fixed thereto to hold the cutting blade 19 by means of the backing plate 23 and the individually formed abutment member 51.

By individually forming a plurality of the abutment members 51, if some of the abutment members 51 are damaged, only the damaged abutment members 51 may be replaced by new ones. Accordingly, replacement operation of the abutment member 51 can be carried out efficiently at a reduced replacement cost.

As described above, according to the present invention, a cutting blade is securely held to enable a veneer to be peeled off in a substantially uniform thickness.

Further, according to the present invention, damage to a blade stock per se can be prevented to improve operational efficiency of a veneer lathe per se and to reduce a maintenance cost.

What is claimed is:

1. A cutting blade holding device in a veneer lathe, said cutting blade holding device being supported by a frame of the veneer lathe with its cutting blade kept in parallel with a log to be peeled, and said cutting blade holding device comprising:

a blade stock having a side thereof facing the log formed with a blade retaining portion for retaining the cutting blade, the cutting blade being detachably mounted in the blade retaining portion of the blade stock, and an abutment member as a member separate from the blade stock, which is separately replaceably disposed in the upper end portion of the blade retaining portion in the vicinity of a cutting edge of the cutting blade mounted in the blade retaining portion.

2. The cutting blade holding device in a veneer lathe according to claim 1, further comprising a backing plate interposed between the blade retaining portion of the blade stock and the cutting blade.

3. A cutting blade holding device in a veneer lathe which peels off a veneer with a cutting blade caused to abut on a peripheral surface of a log chucked by spindles to rotate in a predetermined direction, said cutting blade holding device comprising:

a blade stock supported movably relative to a body frame in a veneer traveling direction perpendicular to an axis of the spindles, and having its upper side in terms of the veneer traveling direction formed with a cutting blade retaining portion having notches, a backing plate mounted on the upper side of the blade stock in terms of the veneer traveling direction with the top of its upper side in terms of the veneer traveling direction located adjacently to a cutting edge of the cutting blade, and having its upper surface formed into a first guide surface extending from the upper course toward the lower course in its section along the veneer traveling direction, an abutment member mounted on the blade retaining portion of the blade stock located on the lower side of the backing plate in terms of the veneer traveling direction, and having its upper side in terms of the veneer traveling direction formed with an engagement portion for engaging with the upper notch, and having its upper surface formed into a second guide surface whose upper end in terms of veneer traveling direction is substantially continuous with the lower end of the first guide surface of the backing plate in terms of the veneer traveling direction and which extends from the upper course toward the lower course in its section along the veneer traveling direction, and blade presser members supported on the upper side of the blade stock in terms of the veneer traveling direction for oscillation, which press the cutting blade supported on the upper end of the backing plate in terms of the veneer traveling direction to secure the cutting blade.

4. A cutting blade holding device in a veneer lathe which peels off a veneer with a cutting blade caused to abut on a peripheral surface of a log chucked by spindles to rotate in a predetermined direction, said cutting blade holding device comprising:

a blade stock supported movably relative to a body frame in a veneer traveling direction perpendicular to an axis of the spindles, and having its upper side in terms of the veneer traveling direction formed with a cutting blade retaining portion having notches, a backing plate mounted on the upper side of the blade stock in terms of the veneer traveling direction with the top of its upper side in terms of the veneer traveling direction located adjacently to a cutting edge of the cutting blade, and having its upper surface formed into a third guide surface extending from the upper course toward the lower course in its section along the veneer traveling direction, and having its lower side in terms of the veneer traveling direction formed with an engagement portion, an abutment member mounted on the blade retaining portion of the blade stock located on the lower side of the backing plate in terms of the veneer traveling direction, and having its upper side in terms of the veneer traveling direction formed with an engagement portion for engaging with both the upper notch of the cutting blade retaining portion and the engagement portion of the backing plate, and having its upper surface formed into a fourth guide surface whose upper end in terms of veneer traveling direction is substantially continuous with the lower end of the third guide surface of the backing plate in terms of the veneer traveling direction and which extends from the upper course toward the lower course in its section along the veneer traveling direction, and blade presser members supported on the upper side of the blade stock in terms of the veneer traveling direction for oscillation, which press the cutting blade supported on the upper end of the backing plate in terms of the veneer traveling direction to secure the cutting blade.

5. A cutting blade holding device in a veneer lathe, said cutting blade holding device being supported by a frame of the veneer lathe with its cutting blade kept in parallel with a log to be peeled, and said cutting blade holding device comprising:

a blade stock having a side thereof facing the log formed with a blade retaining portion for retaining the cutting blade, the cutting blade being detachably mounted in the blade retaining portion of the blade stock, an abutment member as a member separate from the blade stock, which is separately replaceably disposed in the upper end portion of the blade retaining portion in the vicinity of a cutting edge of the cutting blade mounted in the blade retaining portion, and a backing plate interposed between the blade retaining portion of the blade stock and the cutting blade.

* * * * *